United States Patent [19]

Arnold et al.

[11] Patent Number: 4,684,261

[45] Date of Patent: Aug. 4, 1987

[54] METHOD FOR ENTERING A SWITCHING PROGRAM INTO AN ELECTRONIC TIMER AND ARRANGEMENT FOR IMPLEMENTING THE METHOD

[75] Inventors: Werner Arnold, Nuremberg; Hans Grasser, Eckental; Tilmann Kruger, Neunkirchen; Alfred Meisner, Nuremberg, all of Fed. Rep. of Germany

[73] Assignee: Diehl GmbH & Co., Fed. Rep. of Germany

[21] Appl. No.: 615,133

[22] Filed: May 30, 1984

[30] Foreign Application Priority Data

Jun. 11, 1983 [DE] Fed. Rep. of Germany ..... 3321223

[51] Int. Cl.[4] ..... G04F 8/00

[52] U.S. Cl. ..... 368/107; 368/89; 219/492

[58] Field of Search ..... 368/89–112; 219/492, 493, 10.55 B

[56] References Cited

U.S. PATENT DOCUMENTS

| | | | |
|---|---|---|---|
| 4,266,118 | 5/1981 | Takase et al. | 219/492 |
| 4,345,145 | 8/1982 | Norwood | 219/492 |
| 4,517,429 | 5/1985 | Horinouchi | 219/10.55 B |
| 4,636,949 | 1/1987 | Longabaugh | 219/492 |

FOREIGN PATENT DOCUMENTS 3123711 5/1983 Fed. Rep. of Germany .

*Primary Examiner*—Bernard Roskoski
*Attorney, Agent, or Firm*—Scully, Scott Murphy & Presser

[57] ABSTRACT

A method and arrangement for entering a switching program into an electronic timer, in particular a kitchen range timer, wherein the switching program consists of at least one switching cycle within a predetermined time range, preferably within 23 hours and 59 minutes. The switching cycle is timely defined through any two of three entities consisting of switching cycle-start, switching cycle-period and switching cycle-end, wherein the entry is effected serially in the form of sequential input pulses, which have an information relative to the setting direction (forward or backwards) associated therewith, and which is preferably counted in a forward-backward counter arrangement. The entry of a first entity for the definition of the switching cycle is limited to a time interval between the actual time and the end of a pregiven first program range, in which upon the entry of the entity switching cycle-start or switching cycle-end there is set with the first input pulses the present entity to a starting value most closely to the present limit of the first program range but within the first program range, and wherein upon the entry of an input pulse with an associated setting direction which would set the value of the present entity outside of the first program range, causes this input pulse to be rendered ineffective or to selectively erase the present entity.

6 Claims, 1 Drawing Figure

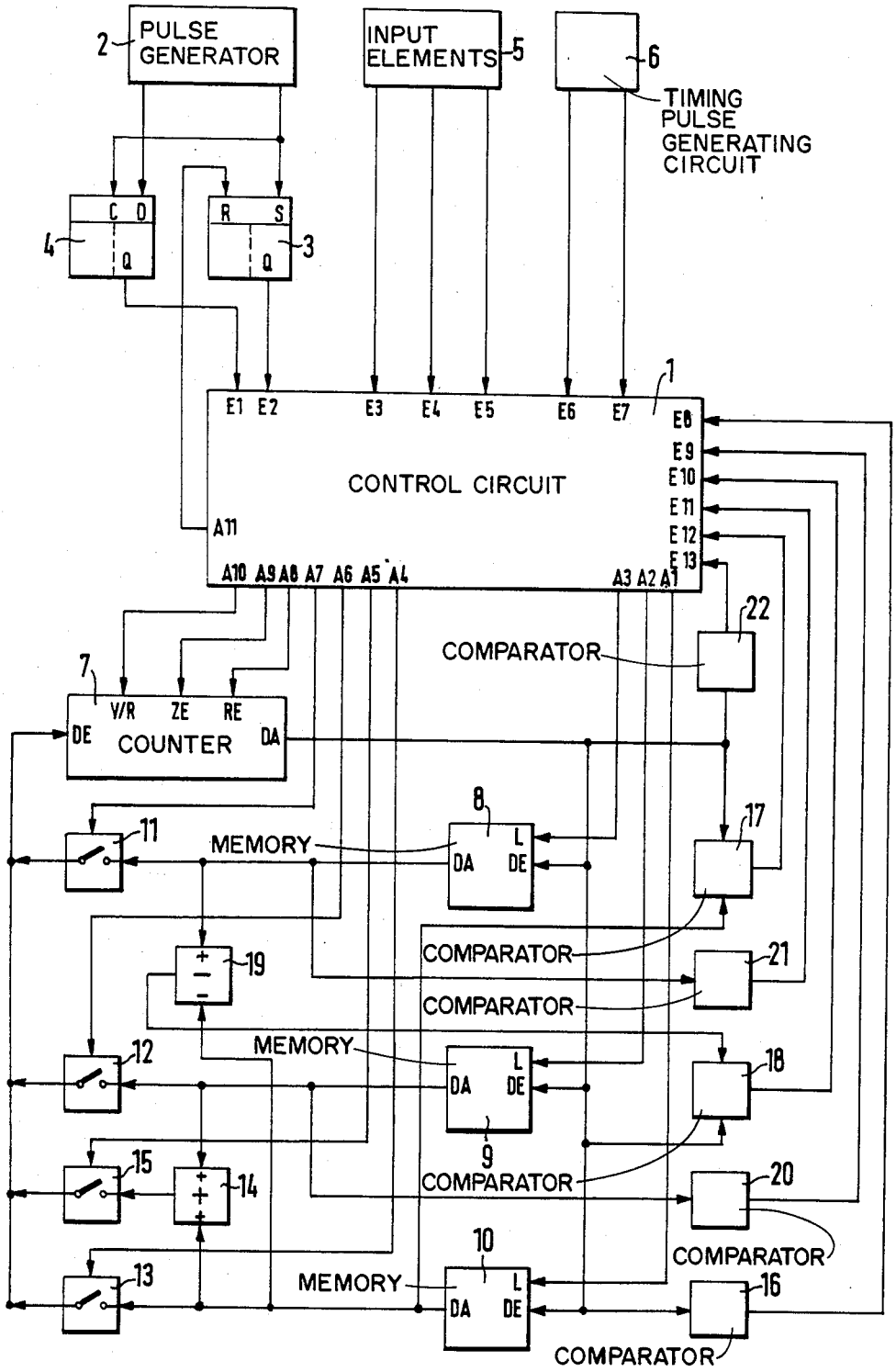
PULSE GENERATOR
2
INPUT ELEMENTS
5
6
TIMING PULSE GENERATING CIRCUIT
C D
Q
4
R S
Q
3
1
E1 E2 E3 E4 E5 E6 E7
E8
E9
E10
E11
E12
E13
CONTROL CIRCUIT
A11
A10 A9 A8 A7 A6 A5 A4
A3 A2 A1
22
COMPARATOR
7
V/R ZE RE
DE COUNTER DA
8
11
MEMORY
L
DA DE
17
COMPARATOR
19
21
COMPARATOR
12
MEMORY
L
DA DE
18
9
15
14
COMPARATOR
20
COMPARATOR
10
13
MEMORY
L
DA DE
16
COMPARATOR

METHOD FOR ENTERING A SWITCHING PROGRAM INTO AN ELECTRONIC TIMER AND ARRANGEMENT FOR IMPLEMENTING THE METHOD

BACKGROUND OF THE INVENTION

1. Field of the Invention

The present invention relates to a method for entering a switching program into an electronic timer, in particular a kitchen range timer, wherein the switching program consists of at least one switching cycle within a predetermined time range, preferably within 23 hours and 59 minutes, in which the switching cycle is timely defined through any two of three entities consisting of switching cycle-start, switching cycle-period and switching cycle-end, wherein the entry is effected serially in the form of sequential input pulses, which have an information relative to the setting direction (forward or backwards) associated therewith, and which is preferably counted in a forward-backward counter arrangement.

2. Discussion of the Prior Art

Procedures of the above-mentioned type for the entering of switching programs into electronic timers are, in general, currently known in the technology. Thus, a series of electronic timers is presently being marketed in which there is effected an entry serially in the form of sequential pulses, and which has information respecting the setting direction associated therewith. For example, the entry can hereby be effected by means of pushbuttons in that, through the actuation of one pushbutton or a combination of pushbuttons, there are generated individual pulses or entire pulse trains for achieving a rapid setting. The entry, however, can also be effected through pulse generators in the form of manually rotatable elements in which, proportional to the turning speed and direction of rotation, there are generated a series of pulses with associated information for the direction of rotation.

In a timer of that type, switching cycles are defined by the entry of any two of three entities, such as switching cycle-start, switching cycle-period, and switching cycle-end, whereby under the term switching cycle, as also set forth hereinbelow, there should be understood that this pertains to that time interval during which the timer actively influences its switching output (switches on, off or switches over).

When the clock possesses a limited indicating display range, for example 24 hours or one week, then the entry of a switching term is meaningful only within a time range which lies between the actual time and a time point constituted of the actual time plus a display range. When, for instance, there is entered into a clock having a 24 hour display parameter, a switching cycle which begins 22 hours after the actual time, and which ends 26 hours after the actual time, then the switching cycle-end for the timer is 2 hours after the actual time, in effect, prior to the switching cycle-start, which can then lead to appreciable erroneous functions. In particular, for kitchen range timers which control the heating of range cooking plates or burners, that type of erroneous operation it can lead to a series of damages, such as overheating of the cooking plate or burner, burning or charring of the cooking ingredients, and the like.

Furthermore, there are also known electronic kitchen range timers which, for example, under the registered trademark "ORBITRON" are kitchen range timers sold by the present applicants, wherein the time range provided for the entry of the cooking duration, which is identical with the entity switching cycle-period, is limited to a predetermined time range (6 hours).

SUMMARY OF THE INVENTION

It is a basic object of the invention to provide a method for the entry of a switching program into a timer, in which there is dependably prevented the entering of erroneous switching cycle data.

Accordingly, it is a more specific object of the present invention to provide a method for the entry of a switching program into an electronic timer, in which in the entry of a first entity for the definition of the switching cycle is limited to a time interval between the actual time and the end of a pregiven first program range, in which upon the entry of the entity switching cycle-start or switching cycle-end there is set with the first input pulses the present entity to a starting value most closely to the present limit of the first program range but within the first program range, and wherein upon the entry of an input pulse with an associated setting direction which would set the value of the present entity outside of the first program range, causes this input pulse to be rendered ineffective or to selectively erase the present entity.

Pursuant to another aspect of the invention, there is entered as the first entity the switching cycle-period and as the second entity the switching cycle-start, and that upon the entry for the definition of the second entity, the time range available for the new switching cycle is limited to a second program range, in which the second program range is equal to the time interval between the bounding values of actual time and actual time plus the first program range minus switching cycle-period.

In accordance with another aspect of the invention there is entered the switching cycle-period as the first entity, and the switching cycle-end as the second entity, and wherein upon the entry for the definition of the second entity, the time range available for the new switching cycle is limited to a second program range, in which the second program range is equal to the time interval between the bounding values of actual time plus switching cycle-period and actual time plus the first program range.

Further advantageous embodiments of the inventive method can be clearly ascertained from the description set forth hereinbelow in which, among other variations, this relates to the combination of entities which can be entered for the defining of a switching cycle.

In particular, through a combination of one of the two entities consisting of switching cycle-period or switching cycle-end with one of the presently two remaining entities, can there be achieved a shortened programming in which the entry of only one of the first-mentioned entities is sufficient, inasmuch as the other entity switching cycle-start which is necessary for the definition of a switching cycle is set equal to the actual time. This preferred embodiment can be utilized, for example, in kitchen range timers for short-term timing with end switch-off.

A preferred embodiment of an arrangement for the implementation of the inventive method operates with a programmable counter arrangement with a plurality of memories or information storage units for the actual time and two switching cycle entities whereby, through the displacement of the count condition in the respective storages, and the displacement of the storage contents or of the junctions of the storage contents in the programmable counter, the different boundary values which are encountered during the method can be realized. In particular, this displacement of count conditions, or in effect the storage contents, can be effected by means of a control circuit which is constructed from standard hardware, or also by means of a suitably programmed microcomputer in which can then also assume the remaining functions of a timer of that type.

BRIEF DESCRIPTION OF THE DRAWINGS

Further advantages and embodiments of the invention can now be ascertained from the following detailed description thereof, taken in conjunction with the single figure of the accompanying drawing illustrating a block circuit diagram of an arrangement for the implementation of the inventive method for the entry of a switching program into an electronic timer.

DETAILED DESCRIPTION

The method proposed herein for the entry of a switching program proceeds from the use of an electronic timer which allows for the programming of at least one switching cycle within a predetermined programming range. Under the term programming range there is to be understood that time range within which the present point in time is clearly defined. Thus, for example, a clock with a 24 hour display, this presently defines a time interval of 24 hours; for a clock with a weekday indication (also during the programming of the timer function) the time interval of one week, and so forth.

This, however, also signifies that only always within the pregiven programming range is it possible to have a clearly defined determination of switching terms which, when required, repeat in the rhythm of the programming range.

Preferably, for timer applications in which the determination of a certain switching program serves for a single program sequence, for example, for kitchen range timers, as previously mentioned problems can be encountered when switching terms are "extended beyond" the end of the programming range, since they will then again lie at the start of the programming range.

For timers in which the entry is carried out serially, in effect, in the form of sequential input pulses, which preferably have associated therewith an information with respect to the setting direction, this problem is solved inasmuch as entries are only possible within the programming range. For this purpose, the current actual time is utilized as a basis, which forms the lower boundary value at the beginning of the programming range and, as a result of the periodic repetition of the same actual time at the end of the programming range, also forms the upper boundary value at the end of the programming range.

A switching cycle can be basically defined through any selected two of the following three entities in an electronic timer of that type:

(a) switching cycle-start
(b) switching cycle-period
(c) switching cycle-end.

In order to remain within the predetermined programming range during the entry of one of the three entities, the entities consisting of switching cycle-start and switching cycle-end must be set with the first input pulses to a value within the programming range, which value is meaningfully set to a value within the programming range which is closest to the present limit or boundary of this programming range.

This value can, for example, at a subdivision into one minute during the programming (meaning, the smallest programmable time unit consists of one minute) consist of the actual time +/− one minute.

Preferably, the entry can hereby be additionally restricted to one setting direction; meaning, the presently first input pulses only become effective when there is associated therewith a certain pregiven setting direction, for example, "forward". This, for example, is meaningful for kitchen range timers which are preferably programmed with a switching cycle at the start of the programming range, thus within the next few hours commencing from the actual time.

Furthermore, there is prevented that during the program of such type of timer, to again leave this programming range. For this purpose, input pulses to one of the three mentioned magnitudes with an associated setting direction, which would set this value of these magnitudes externally of the programming range, are rendered ineffective for selectively this magnitude is extinguished.

At an entry which is possible in two directions, upon an attempt to pass beyond the upper boundary of the programming range, preferably the applicable input pulse is rendered ineffective, whereas during an attempt to pass beyond the lower boundary value or limit of the programming range, there is preferably erased the present entity.

For timers in which it is possible to have only one setting direction ("forward"), it is advantageous that upon reaching of the upper boundary there is effected an erasing of the present entities so that these can be thereafter again entered.

For a timer with a 24-hour time display, in which the display does not show 0.00 (but, for example, the display sequence 23.59–24.00–0.01 for the sequentially following minutes) this value 0.00 is preferably utilized in order to represent an erased entity. When, for example, at an actual time of 11.00 o'clock in a timer of that type there is entered the entity of switching cycle-end, then the display of this entity jumps with the first input pulse from 0.00 to 11.01 o'clock, and can be set forwardly up to a maximum of 10.59 o'clock (of the next day). When in contrast therewith, during a setting back, there is again reached the value 11.01 o'clock, then upon continued setting back there is erased the entity of switching cycle-end; meaning, the display jumps from 11.01 o'clock to 0.00.

A special case which is present in this entry method is the entry of the entity of switching cycle-period, to the extent in that this does not relate to a predetermined time, but to a time period or interval. Nevertheless, the switching cycle-period can be restricted in the same manner to the pregiven programming range as are the remaining entities. Thus, for example, for a timer with a 24 hour display, as the maximum upper limiting value of the programming range, there is applicable the switching cycle-period of 23 hours 59 minutes, upon reaching of which, this entity is again erased, or further input pulses with the associated setting direction "forward" are rendered ineffective. When, in contrast, therewith the entity of switching cycle-period is set backwards, then when after reaching the smallest programmable value, for example, one minute, further setting is carried out, the switching cycle-period is set to zero (display preferably 0.00), and further input pulses with the same setting direction are rendered ineffective; in essence, this entity is also erased.

When the second entity is entered, which is necessary for the complete definition of a switching cycle, then in a meaningful manner, this should not overlap with the first entered entity; in effect for instance under circumstances the entity switching cycle-end located in time ahead of the entity switching cycle-start. Thereby, the time range which is available for the entry of the second entity should be restricted to a second programming range within the previous programming range. The previous programming range is described hereinbelow for a better distinction with regard to the first programming range.

Herein, the second programming range is dependent upon which of the three entities is entered as the first, and which of the three entities is entered as a second. For reasons of clarity, the bounding values or limits of the second program range are represented hereinbelow in the form of a table which utilizes the following abbreviations:

S switching cycle-start
P switching cycle-period
E switching cycle-end
N length of the first programming range
AT present or actual time

| first entered entity | second entered entity | second programming range boundary value | |
|---|---|---|---|
| S | P | O | AT + N − S |
| P | S | AT | AT + N − P |
| S | E | S | AT + N |
| E | S | AT | E |
| P | E | AT + P | AT + N |
| E | P | O | E − AT |

In this table there is presently shown the combination of two of the three entities for the definition of a switching cycle, and there are indicated the boundary or limiting values of the second programming range which are dependent upon the series sequence of the entry. Hereby, as in the description of the first entry, care must again be exercised that the entities of switching cycle-start and switching cycle-end are defined by a clock time, for example, 11.23 o'clock, whereas the entity of switching cycle-period is defined by a time period or duration, such as for example, 1 hour 30 minutes.

Hereby, within the context of the invention, it is possible to voluntarily restrict the programming range for the entity switching cycle-period, for instance, to 6 hours for preferably kitchen range timers since, in practice, lengthier cooking periods are not used, and the entry procedure is thereby further shortened. This signifies that in the foregoing table, last column, first and last line, the bounding indications AT plus N - S, or E-AT are only applicable to the extent in that they are less than or equal to 6 hours.

A preferred implementation of the method additionally allows for the input of only one entity for the definition of a switching cycle. Hereby, when one of the entities consisting of switching cycle-period or switching cycle-end is entered, then as the second entity for the definition of the switching cycle there is concurrently voluntarily set the entity of switching cycle-start to the actual time.

Through this advantageous modification, it is also possible to utilize a timer which is to be programmed pursuant to this method, in a function as a short term timer with end switch-off. It would be more meaningful when in this application of the entry method, the second entity is entered for the definition of a switching cycle, the automatically set entity of switching cycle-start is equal to actual time is again automatically erased, or newly defined.

A further preferred application of the method finally allows the concurrent erasing of all already present entities for the definition of a switching cycle, in that only one of these entities is erased. Rendered possible thereby is an extremely rapid total erasure of, for example, a no longer required switching cycle.

Hereinbelow, there is now set forth a detailed description of a preferred embodiment of the inventive arrangement, taken on the basis of the single figure of the drawing showing a schematically illustrated block circuit diagram of the arrangement for the implementation of the preferred entry method in which, for the definition of a switching cycle, there are utilized the entities consisting of the switching cycle-period and switching cycle-end.

In this arrangement there is employed a control circuit 1 which, as required, includes inputs E1 through E13 and outputs A1 through A11. The further circuit components are not illustrated. For example, as a control circuit 1 there can serve a fixedly-programmable memory or information storage, whereby the inputs E1 through E13 then serve as addressing inputs, and by means of the outputs A1 through A11 there are retrievable the respective memory or storage contents.

Furthermore, for the control circuit 1 there can also be employed a gating grid, a multiplexer module, or the like. It is merely a prerequisite herein that each input address at the inputs E1 through E13 have a certain pregiven presettable output address at the outputs A1 through A11 associated therewith.

The control circuit 1 hereby receives input addresses from, preferably, a pulse generator 2 which generates input pulses which are interimly stored in an SR-flip-flop 3. After the reading-in of the input pulses, the SR-flip-flop 3 is reset by the control circuit 1 (output A11). Furthermore, the pulse generator 1 generates an information with regard to the setting direction which is associated with the input pulses, which is interimly stored in a dynamic flip-flop 4 (E2). Moreover, there are present input or entry elements 5, such as pushbuttons, which associate the input pulses from the pulse generator 2 with a predetermined entity, preferably the actual time, switching cycle-period and switching cycle-end, in that there are actuated the inputs E3, E4 and E5 of the control circuit 1. Finally, the control circuit 1 is actuated, for example through the inputs E6, E7, from a timing pulse-generating circuit 6, which preferably delivers a rhythm pulse and a timing pulse. The timing pulse can consist, for example, of pulses with a period duration of one second, whereas the higher-frequencied, rhythm pulse determines the reading frequency for the input addresses present at the inputs E1 through E13 of the control circuit 1.

For the formation of the switching cycle terms and the actual time, the arrangement includes a programmable forward-backward counter arrangement 7 with a data input DE and a data output DA, wherein the data output DA of the forward-backward counter arrangement 7 is connected with the data inputs DE of an end-storage or memory 8 for the entity of switching cycle-end, a period-storage or memory 9 for the entity of switching cycle-period, and an actual time storage or memory 10. The storages 8, 9, 10 each incorporate a loading input L, which can be actuated from the outputs A1, A2, A3 of the control circuit 1. Preferably, employable as the counter arrangement 7 can be a modulo-K counter, whose count range K is equal to the display capacity of the clock; in effect, such as 24 hours.

During an actuation of a load input L, the data which are present at the data input DE of the currently actuated storage or memory 8, 9, 10, and which are identical with the condition of the counter arrangement 7, are assumed by the respective data storage 8, 9, 10. Moreover, the storages 8, 9, 10 each include a data output DA, each of which are connectable through a respective controllable switch 11, 12, 13 having control inputs ST with the data input DE of the counter arrangement 7. The control inputs ST of the controllable switches 11 through 13 are actuatable from the outputs A4, A6, A7 of the control circuit 1; at a corresponding actuation, the counter arrangement 7 then assumes the content of the respective storage 8, 9, 10 as the basis for a counting of pulses.

Additionally, the data outputs DA of the actual time-storage or memory 10 and the period-storage or memory 9 are connected with an adder 14, preferably a modulo-K adder (K=the display capacity of the clock, for example, 24 hours). The output of the adder 14 is similarly connectable through a further controllable switch 15 having a control input ST with the data input DE of the counter arrangement 7. This control input ST can, as required, be actuated from the output A6 of the control circuit 1, so that the counter arrangement 7 can then be loaded with the sum of the actual time and the entity of switching cycle-period.

The programmable forward and backward count arrangement 7 includes, in addition to the data input DE and the data output DA, a counting input ZE which is actuated from the output A9 of the control circuit 1; an input V/R for the reversal of the counting direction which is actuated from the output A10 of the control circuit 1; and a resetting input RE which is actuated from the output A8 of the control circuit.

In order that, by means of the control circuit 1, there can be meaningfully operated the arrangement from the data storages 8, 9, 10 and the counter arrangement 7, information with respect to their present conditions must be conveyed to the control circuit 1. This is effected through a series of comparator circuits.

For this purpose, the data output DA of the counter arrangement 7 is connected with a first comparator 16 which tests as to whether the count condition is equal to zero and, if required, delivers a signal to the input E8 of the control circuit 1. A second comparator 17 compares the count condition with the content of the actual time storage 10 and, at equality, delivers a control signal to the input E12 of the control circuit 1. A third comparator 18 finally compares the count condition with the entity of switching cycle-end minus the actual time and, at equality, generates a control signal for the input E10 of the control circuit 1. This entity of switching cycle-end minus actual time is produced by a subtractor 19, preferably by a modulo-K subtractor (K=the display capacity of the clock), which joins the storage inputs present at the data outputs DA of the end-storage arrangement 8 and the actual time storage arrangement 10. Finally, a forth comparator 20 tests the content of the period-storage arrangement 9 with regard to zero and, if required, delivers a control signal to the input E9 of the control circuit 1. A fifth comparator 21 tests the content of the end-storage arrangement 8 with regard to zero and, if required, delivers a control signal to the input E11 of the control circuit 1. A sixth comparator 22 tests the condition of the count arrangement 7 at a predetermined upper limit, for example 23 hours 59 minutes and, if required, delivers a control signal to the input E13 of the control circuit 1.

In an arrangement of that type, as described hereinabove, all changes in the entities of switching cycle-period, switching cycle-end, and actual time take place in the counter arrangement 7. Changes of that kind can be generated, at first, through the generation of input pulses by means of the pulse generator 2, or also through the timing pulse at the pulse generating circuit 6.

During normal operation of the clock; in effect, when no entries are implemented, the counter arrangement 7 counts the timing pulse from the pulse generating circuit 6. After appearance and the counting of each new synchronizing or rhythmic pulse, the actual clock time is loaded into the actual time-storage arrangement 10.

Thereafter, the counter arrangement 7 is available for other tasks until the appearance of the subsequent timing pulse. When the count condition, at the appearance of the subsequent timing pulse, is not equal to the stored actual time, which is determined by means of the second comparator 17, in effect, in the interim the counter arrangement 7 was utilized for other purposes, then the actual time is loaded from the actual time-storage 10 through the controllable switch 13 into the counter arrangement 7, and only then is the timing pulse counted thereto. Furthermore, the counter arrangement 7 is tested relative to the count condition zero by means of the first comparator 16 after the actual time has been loaded from the storage 10 into the counter arrangement 7. When this condition is fulfilled, this then signifies that the actual time was erased, for example, through a power outage. The timing pulse is then rendered ineffective and there can additionally be placed in operation a power outage indicating device (not shown). For this instance, by means of the input or entry elements 5 (actual time-pushbutton) and the pulse generator 2, there can be entered a new actual time into the counter arrangement 7. The entry of the switching cycle terms is effected through the input elements 5 (switching cycle-period and switching cycle-end pushbutton) in conjunction with the pulse generator 2.

Upon actuation of the applicable input elements 5, the counter arrangement 7 is loaded with the contents of the respective storages 8, 9 through the applicable controllable switch 11, 12. Concurrently, a fourth and fifth comparator 20, 21 determines as to whether the storage contents are equal to zero. When this is fulfilled, then upon the entry of the entity of switching cycle-end, the content of the actual time-storage 10 is loaded into the counter arrangement 7, and upon the entry of the entity of switching cycle-period the counter arrangement 7 is reset to zero. Thereafter, there can be effected the input of the count pulses, whereby at least the first pulse must have the counting direction "forward" associated therewith, since otherwise the entry remains ineffective. During the further input or entry the count condition is monitored for an upper bound, and namely during the entry of the entity of switching cycle-end by means of the second comparator 17 (comparing count condition and actual time), and during the entry of the entity of switching cycle-period by means of the sixth comparator 22 (count condition equals 23 hours 59 minutes or a suitable lower value). Upon reaching of these upper limits or bounds, the further entries are rendered inoperative in the direction "forward".

When at the entry of the entity of switching cycle-end there is reached a lower boundary or limit in the direction "rearward", which is similarly determined through the second comparator 17 (comparing count condition and actual time), then the counter arrangements 7 is set to zero; in essence, the entity of switching cycle-end is erased.

When there is effected an entry of new switching cycle terms for the purpose of correcting already entered switching cycle terms, or for the completion of an already previously entered entity so as to provide for the complete defining of a switching cycle, then the content of the applicable data storage or memory 8, 9 is loaded into the counter arrangement 7. When the entity of switching cycle-period has already been entered, then the counter arrangement 7, during the input of the entity of switching cycle-end, insofar as the content of the end-storage 8 is equal to zero, will be loaded through the controllable switch 15 with the value of the actual period plus switching cycle-period which is present at the output of the adder 14. When the entity of switching cycle-end has already been entered, then the counter arrangement 7 is monitored at a subsequent switching cycle-period input that the count condition will not exceed the time interval which is available between the actual time and the switching cycle-end. This is effected by means of a third comparator 18, which compares the count condition with the value which is present at the output of the subtractor 19. Hereby, the subtractor 19 delivers the entity of switching cycle-end minus the actual time.

The arrangement as described hereinabove only represents the components of an electronic timer which are employed in conjunction with the inventive entry method. For the completion of a timer construction, it is necessary to provide a display arrangement which is connected with the counter arrangement 7, as well as a voltage supply and a switching arrangement in which the last-mentioned can switch on or switch off an appliance upon, for instance, the coincidence of the entities of the actual time and the switching cycle-end minus switching cycle-period, or switching cycle-end.

Furthermore, within the scope of the invention it is possible that the functions of an electronic timer which is constructed with standard hardware as described hereinabove can also be effectuated by a suitably programmed and circuited microcomputer.

What is claimed is:

1. In a method for the entry of a switching program into an electronic timer, the switching program consisting of at least one switching cycle within a predetermined time range, such as within 23 hours 59 minutes, wherein the switching cycle is defined in time through any two of three entities consisting of switching cycle-start, switching cycle-period and switching cycle-end, and wherein the entry is effected serially in the form of sequential input pulses, information with respect to the setting direction being associated with said pulses, said pulses being counted into forward-backward counter means; the improvement comprising:

defining a switching cycle by the entities of switching cycle-start and switching cycle-period, entering the switching cycle-start as the first entity and entering the switching cycle-period as the second entity;

limiting the entry of said first entity for defining of the switching cycle to a time interval between the actual time and the end of a pregiven first program range;

setting said first entity consisting of switching cycle-start with first input pulses from a starting value close to one of the present limits of the first program range but within the first program range; and limiting the time interval available at the input for defining the second entity to a second program range within the pregiven first program range, wherein said second program range is limited to the time interval between the boundary value of zero and the actual time plus the first program range minus switching cycle-start;

rendering said input pulse inoperative or selectively erasing the applicable entry upon the input of an input pulse with an associated setting direction which would set the value of the applicable entity outside of the first program range, and wherein at least the first input pulse for the definition of an entity of a switching cycle is operative only upon a pregiven setting direction being associated with said input pulse.

2. Method for the entry of a switching program into an electronic timer, such as a kitchen range timer, the switching program consisting of at least one switching cycle within a predetermined time range, such as within 23 hours 59 minutes, wherein the switching cycle is defined through two entities consisting of switching cycle-period and switching cycle-start; effecting the entry serially in the form of sequential input pulses; information with respect to the setting direction being associated with said pulses, said pulses being counted in a forward-backward counter means; the improvement comprising:

limiting the entry for defining of the first entity of switching cycle-period to a first program range which is shorter than or equal to the length of the predetermined time range;

entering the switching cycle-period as the first entity and the switching cycle-start as the second entity; and limiting the time range available for the entry of the second entity to a second program range, wherein the second program range is equal to the time interval between the limiting values of actual time and actual time plus the first program range minus switching cycle-period.

3. Method as claimed in claim 1, comprising defining a switching cycle through the entities of switching cycle-start and switching cycle-end; entering the switching cycle-start as first entity and the switching cycle end as the second entity; and limiting the second program range to the time interval between the limiting values of switching cycle-sart and actual time plus the first programming range.

4. Method as claimed in claim 1, comprising defining a switching cycle through the entities of switching cycle-start and switching cycle-end; entering the switching cycle-end as the first entity and the switching cycle-start as the second entity; and limiting the second program range to the time interval between the boundary values of actual time and switching cycle-end.

5. Method for the entry of a switching program into an electronic timer, such as a kitchen range timer, the switching program consisting of at least one switching cycle within a predetermined time range, such as within 23 hours 59 minutes, wherein the switching cycle is defined through two entities consisting of switching cycle-period and switching cycle-end, effecting the entry serially in the form of sequential input pulses, information with regard to the setting direction being associated with said pulses, counting said pulses into forward-backward counter means; the improvement comprising:

limiting the entry for defining of the first entity of switching cycle-period to a first programming range which is shorter than or equal to the length of the predetermined time range;

entering the switching cycle-period as a first entity and the switching cycle-end as a second entity, and limiting the time range available for the entry of the second entity to a second programming range, wherein said second programming range is equal to the time interval between the boundary values of actual time plus switching cycle-period and actual time plus first programming range.

6. Method as claimed in claim 1, wherein upon an entry for the erasing of one of the switching cycle terms, there are erased all entities for the defining of a switching cycle.

* * * * *